US009637308B2

(12) United States Patent
Nichols

(10) Patent No.: US 9,637,308 B2
(45) Date of Patent: May 2, 2017

(54) UNITARY ORNAMENTAL FRONT LOAD CONTAINERS, ORNAMENTAL SURROUNDS, AND FRONT LOAD CONTAINERS

(71) Applicant: Dumpster Dress LLC, Latham, NY (US)

(72) Inventor: Paul Nichols, Latham, NY (US)

(73) Assignee: DUMPSTER DRESS LLC, Latham, NY (US)

( * ) Notice: Subject to any disclaimer, the term of this patent is extended or adjusted under 35 U.S.C. 154(b) by 45 days.

(21) Appl. No.: 14/715,091

(22) Filed: May 18, 2015

(65) Prior Publication Data

US 2016/0288997 A1 Oct. 6, 2016

Related U.S. Application Data

(63) Continuation-in-part of application No. 29/522,771, filed on Apr. 2, 2015, now Pat. No. Des. 749,809.

(51) Int. Cl.

| | |
|---|---|
| ***B65F 1/14*** | (2006.01) |
| ***B65F 1/02*** | (2006.01) |
| *B65F 1/12* | (2006.01) |

(52) U.S. Cl.

CPC ..... *B65F 1/14* (2013.01); *B65F 1/02* (2013.01); *B65F 1/122* (2013.01);

(Continued)

(58) Field of Classification Search

CPC ..... B65F 1/14; B65F 1/1452; B65F 1/122; B65F 1/125; B65F 1/08; B65F 2250/114; B65F 2210/132

(Continued)

(56) References Cited

U.S. PATENT DOCUMENTS

| | | | |
|---|---|---|---|
| 3,226,015 | A | 12/1965 | Manfredonia |
| 3,647,102 | A | 3/1972 | Cooley |

(Continued)

OTHER PUBLICATIONS

Talking Trash: Visual Artist "Finley" Dresses Up Dumpsters, Retrieved from: http://www.wwd.com/eye/design/talking-trash-visual-artist-finley-dresses-up-dumsters-2406055; published on Jan. 8, 2010.

(Continued)

*Primary Examiner* — Stephen Castellano
(74) *Attorney, Agent, or Firm* — Heslin Rothenberg Farley & Mesiti, P.C.

(57) ABSTRACT

Unitary ornamental front load containers for containing trash and/or recyclables include a container for containing the trash and/or recyclables, and an ornamental surround attached with a connector to the front load container. The attached ornamental surround defines right and left front openings aligned with right and left front pocket openings of right and left fork pockets of the container. The ornamental surround obscures from view the front sidewall, the right sidewall having the right fork pocket, the left sidewall having the left fork pocket, the rear sidewall, and the at least one hinged top of the container by an observer standing on the ground. The container and the attached ornamental surround being liftable as a unit by forks of a front loading garbage truck to empty the trash and/or the recyclables from the unitary ornamental front load container.

35 Claims, 16 Drawing Sheets

(52) U.S. Cl.
CPC ... *B65F 2210/132* (2013.01); *B65F 2250/111* (2013.01); *B65F 2250/112* (2013.01); *B65F 2250/116* (2013.01)

(58) Field of Classification Search
USPC ..... 206/515; 220/908, 62.14
See application file for complete search history.

(56) References Cited

U.S. PATENT DOCUMENTS

| | | | | |
|---|---|---|---|---|
| 3,865,449 | A | 2/1975 | McCaslin et al. | |
| 4,046,271 | A * | 9/1977 | Klosk | B65F 1/10 232/43.2 |
| 5,118,173 | A | 6/1992 | Proctor et al. | |
| D332,851 | S | 1/1993 | Long | |
| 5,183,180 | A | 2/1993 | Hawkins et al. | |
| D333,898 | S | 3/1993 | Schulze et al. | |
| D340,331 | S | 10/1993 | Arato et al. | |
| D340,559 | S | 10/1993 | Taylor | |
| 6,296,132 | B1 | 10/2001 | Pickler | |
| D507,687 | S | 7/2005 | Moon et al. | |
| D511,602 | S | 11/2005 | Mazzaferro | |
| 7,073,677 | B2 | 7/2006 | Richardson et al. | |
| 7,198,166 | B2 | 4/2007 | Sholinder | |
| D545,023 | S | 6/2007 | Weiss | |
| D555,862 | S | 11/2007 | Weiss | |
| D556,971 | S | 12/2007 | Hatamian et al. | |
| D560,049 | S | 1/2008 | Hatamian et al. | |
| D603,118 | S | 10/2009 | Gollinucci | |
| D613,019 | S | 3/2010 | Moore | |
| D644,391 | S | 8/2011 | Kopp et al. | |
| D650,141 | S | 12/2011 | Salonen et al. | |
| D659,930 | S | 5/2012 | Sheehan | |
| D659,931 | S | 5/2012 | Sheehan | |
| 8,668,186 | B1 | 3/2014 | Wagner | |
| D714,009 | S | 9/2014 | Phillips et al. | |
| 2005/0263970 | A1 | 12/2005 | Foster-Hentz | |
| 2007/0125778 | A1 | 6/2007 | Uffner et al. | |
| 2010/0108675 | A1 | 5/2010 | Meissen et al. | |
| 2012/0055597 | A1 | 3/2012 | Aznar-Meyer et al. | |
| 2013/0277633 | A1 | 10/2013 | Goode | |

OTHER PUBLICATIONS

Aluminum Waste Containers, Boone Welding, Retrieved from http://boonewelding32609.tripod.com/id16.html; Retrieved on Mar. 29, 2014.
Dumpster Mate, Retrieved from http//www.dumpstermate.com/dumpster-mate/; Retrieved on Mar. 29, 2014.
Upright Fence, Inc., Retrieved from http://www.upright-fence.com/dumpster_enclosures.html; Published on Feb. 5, 2012.
Fence Workshop, Retrieved from http://fenceworkshop.com/dumpster-garbage-enclosures-gates-atlanta/; Published on Jan. 12, 2012.
Wilkerson Properties, Inc., Retrieved from http://wilkersonproperties.com/CityBank-Milwaukee.html; Published on Oct. 10, 2008.
Cedar Grove Fence Specialists, Retrieved from http://www.cedargrovefence.com/gallery/specialty.html; Published on Mar. 16, 2011.
Natural Enclosures, Retrieved from http://www.georgia-fence-company.com/portfolio_items/dumpster-enclosures/; Published on Sep. 7, 2013.
Toledo Fence and Supply Company, Retrieved from http://www.toledofence.com/commercial-gate-fabrications; Published on Aug. 1, 2012.
NPLD 10. Photograph taken on Mar. 20. 2010 of a public use at least as early as May 20, 2014.
NPLD 11, Photograph taken on Mar. 20, 2015 of a public use at least as early as May 20, 2014.
NPLD 12, Photograph taken on Mar. 20, 2015 of a public use at least as early as May 20, 2014.
NPLD 13, Photograph taken on Mar. 20, 2015 of a public use at least as early as May 20, 2014.
NPLD 14, Photograph taken on Mar. 20, 2015 of a public use at least as early as May 20, 2014.
P. Nichols, Design U.S. Appl. No. 29/491,503, filed May 21, 2014, entitled "Refuse Contaner".
P. Nichols, Design U.S. Appl. No. 29/522,771, filed Apr. 2, 2015, entitled "Refuse Container".

* cited by examiner

UNITARY ORNAMENTAL FRONT LOAD CONTAINERS, ORNAMENTAL SURROUNDS, AND FRONT LOAD CONTAINERS

CROSS-REFERENCE TO RELATED. APPLICATIONS

This application is a continuation-in-part of U.S. design patent application Ser. No. 29/522,771, filed Apr. 2, 2015, entitled "Refuse Container," now U.S. Pat. No. D749,809 which application is a continuation of U.S. design patent application Ser. No. 29/491,503, filed May 21, 2014, entitled "Refuse Container," now abandoned the entire subject matter of these applications being incorporated herein by reference.

FIELD OF THE DISCLOSURE

The present disclosure relates generally to refuse containers, and more specifically, to unitary ornamental front load containers, ornamental surrounds, and front load containers.

BACKGROUND

The main purpose of a dumpster is to store rubbish until it is emptied by a garbage truck and disposed of. Dumpsters can be used for all kinds of waste or for recycling purposes. Most dumpsters are emptied weekly by a hired rubbish removal service.

Many businesses, apartment buildings, schools, offices, and industrial sites have one or more dumpsters to store the waste that they generate. Dumpsters are emptied by front-loading garbage trucks. These trucks have large prongs on the front which are aligned and inserted into pockets on the dumpster. Hydraulics then lift the prongs and the dumpster, eventually flipping the dumpster upside-down and emptying its contents into the truck's hopper or storage compartment. Other dumpsters are smaller and are emptied by rear-loading trucks.

There is a need for refuse containers, and more specifically, to unitary ornamental front load containers, ornamental surrounds, and front load containers.

SUMMARY

In a first aspect, the present disclosure provides a unitary ornamental front load container for containing trash and/or recyclable materials. The unitary ornamental front load container includes a container, an ornamental surround disposed around the container, and a connector for attaching the ornamental surround to the container. The container for containing the trash and/or recyclable materials includes a bottom, a front sidewall, a left sidewall having a left fork pocket having a left front pocket opening, a right sidewall having a right fork pocket having a right front pocket opening, a rear sidewall, and at least one hinged top. The ornamental surround includes a facade panel disposed across the front sidewall of the container, a left side panel disposed across the left sidewall and the left fork pocket of the container, a right side panel disposed across the right sidewall and the right fork pocket of the container, and a rear side panel disposed across the rear sidewall. The attached ornamental surround defines a left front opening aligned with the left front pocket opening of the left fork pocket of the container, and the attached ornamental surround defines a right front opening aligned with the right front pocket opening of the right fork pocket of the container. The attached ornamental surround obscures from view the shape of the container by an observer standing on the ground. The container and the attached ornamental surround is liftable as a unit by forks of a front loading garbage truck to empty the trash and/or the recyclable materials from the unitary ornamental front load container.

In a second aspect, the present disclosure provides an ornamental surround attachable to a front load container having a bottom, a front sidewall, a left sidewall, a right sidewall, and a rear sidewall, and at least one hinged top. The left sidewall includes a left fork pocket having a left front pocket opening, and the right sidewall includes a right fork pocket having a right front pocket opening. The ornamental surround includes a facade panel disposable across the front sidewall of the front load container, a left side panel disposable across the left sidewall and the left fork pocket of the front load container, a right side panel disposable across the right sidewall and the right fork pocket of the front load container, a rear side panel disposable across the rear sidewall of the front load container. A connector is provided for attaching the ornamental surround to the container. The attachable ornamental surround defines a left front opening alignable with the left front pocket opening of the left fork pocket of the front load container, and the attachable ornamental surround defines a right front opening alignable with the right front pocket opening of the right fork pocket of the front load container. The attachable ornamental surround is operable for obscuring from view the front sidewall, the left sidewall having the left fork pocket, the right sidewall having the right fork pocket, the rear sidewall, and the at least one hinged top of the front load container by an observer standing on the ground. The front load container and the attached ornamental surround is liftable as a unit by forks of a front loading garbage truck to the empty trash and/or the recyclable materials from the front load container.

In a third aspect, the present disclosure provides a front load container for containing trash and/or recyclable materials. The front load container includes a bottom, a front sidewall, a left sidewall, a right sidewall, and a rear sidewall, and at least one hinged top. The left sidewall and the right sidewall have fork pockets having front pocket openings. The front sidewall, the left sidewall, or the right sidewall includes a sidewall opening. The bottom comprising a sloped bottom portion disposed adjacent to a bottom edge of the sidewall opening and angled downwardly and away from the sidewall opening of the container.

Additional features and advantages are realized through the concepts of the present disclosure. Other embodiments and aspects of the disclosure are described in detail herein and are considered a part of the claims.

BRIEF DESCRIPTION OF THE DRAWINGS

Various aspects of the present disclosure are particularly pointed out and distinctly claimed as examples in the claims at the conclusion of the specification. The foregoing and other objects, features, and advantages of the disclosure are apparent from the following detailed description taken in conjunction with the accompanying drawings in which:

DETAILED DESCRIPTION

The present disclosure addresses and enhances, inter alia, the collection trash or recyclable materials. For example, the present disclosure may include a unitary ornamental front load container having a container and an attached ornamental surround that provides a more pleasing visual appearance compared to conventional steel front load containers. The container and an attached ornamental surround may be transportable as a unit to and from a site such as schools, apartment complexes, shopping centers, and restaurants. While disposed at the site, the unitary ornamental front load container is liftable as a unit by the forks of a front loading garbage truck to empty trash and/or recyclable materials from the unitary ornamental front load container into the garbage truck. In some embodiments, the ornamental surround and container may include aligned side openings or aligned front openings allowing easy access by a user when placing trash or recyclables in the unitary ornamental front load container. In other embodiments, the unitary ornamental front load container may include a sloped bottom that results in discarded trash and/or recyclables placed in the aligned openings sliding downwardly and away from the side or front openings.

Figure 1:
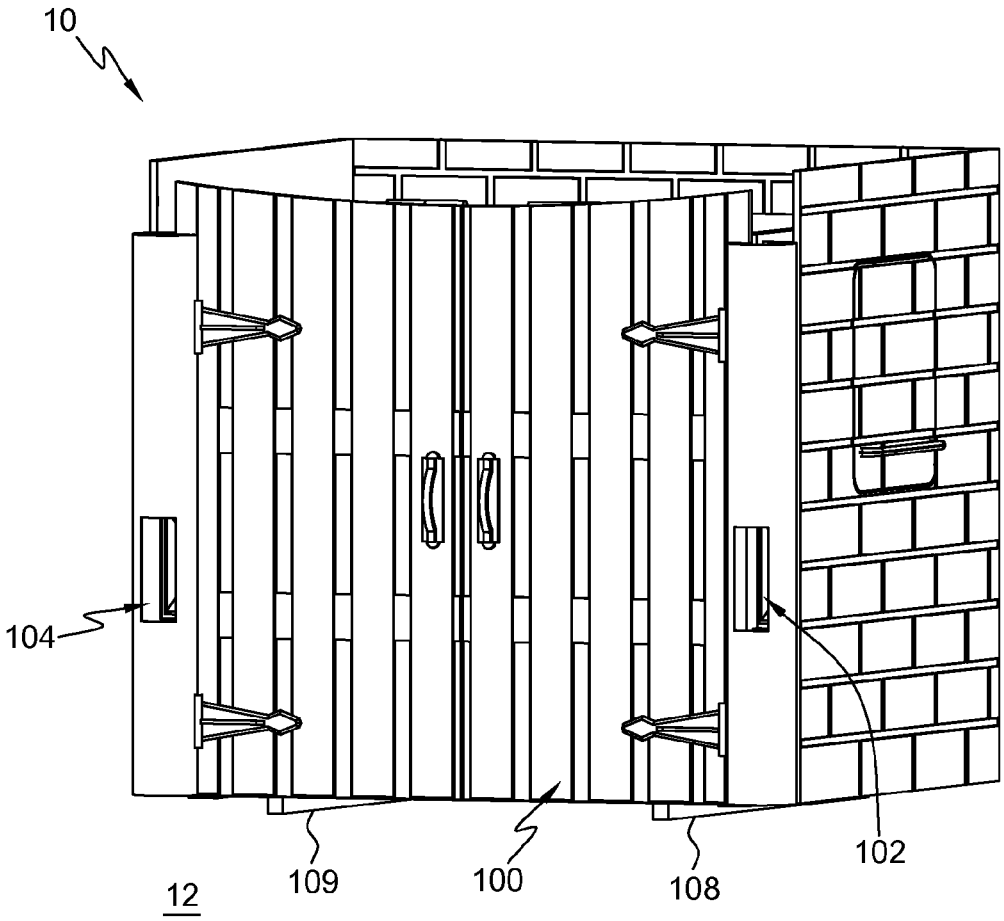
FIG. 1 is a perspective view of a unitary ornamental front load container in accordance with aspects of the present disclosure.

FIG. 1 illustrates a unitary ornamental front load container 10 in accordance with aspects of the present disclosure for containing trash and/or recyclables. As described in greater detail below, unitary ornamental front load container 10 provides a fixedly attached ornamental surround 100 that substantially obscures from view a container disposed therein by an observer standing on the ground 12. The fixedly attached ornamental surround 100 is liftable along with the container as a unit, by forks of a front loading garbage truck, passing through opening 102 and 104 in ornamental surround 100, to empty trash and/or recyclable materials from unitary ornamental front load container 10 into the garbage truck.

Figure 2:
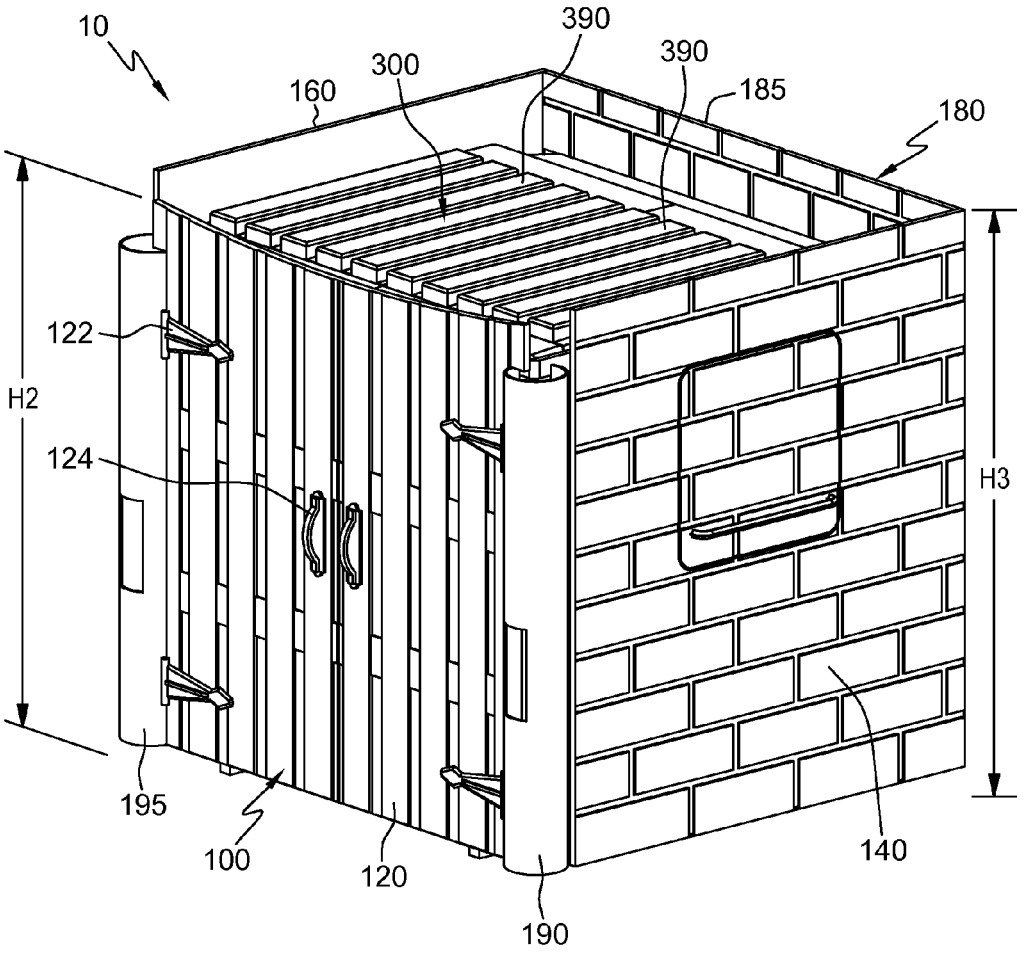
FIG. 2 is a front and a left side perspective view of the unitary ornamental front load container of FIG. 1.
Figure 3:
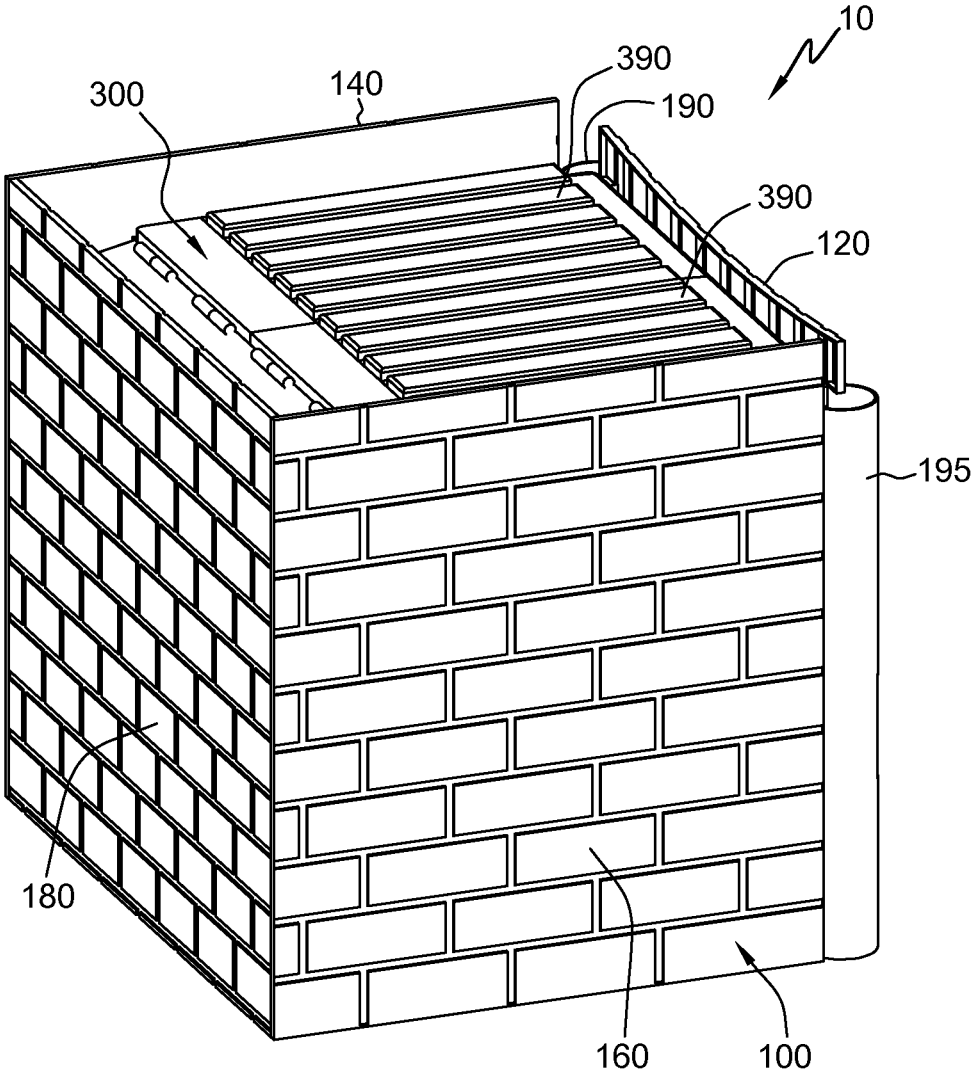
FIG. 3 is a rear and a right side perspective view of the unitary ornamental front load container of FIG. 1.

With reference to FIGS. 2 and 3, in this exemplary embodiment, unitary ornamental front load container 10 includes ornamental surround 100 being attached to a container 300 for containing trash and/or recyclables. Ornamental surround 100 includes a facade panel 120, a left side panel 140, a right side panel 160, and a rear side panel 180. A pair of elongated rounded members, bumpers, or corners 190 and 195 may be disposed between facade panel 120, and left and right panels 140 and 160, respectively. In one embodiment, the facade panel may have the appearance of a slatted gate, and the left side panel, the right side panel, and the rear side panel may have the appearance of being formed from a plurality of bricks or blocks. Facade panel 120 may also include hinges 122 (FIG. 2), and handles 124 (FIG. 2). In this illustrated embodiment, the facade panel, hinges, and handle may be an integral one-piece unit, i.e., halves of the facade not actually operable to hingedly open. It will be appreciated that the ornamental surround may have any suitable ornamental look that provides a more pleasing visual appearance compared to conventional steel front load containers.

Figure 4:
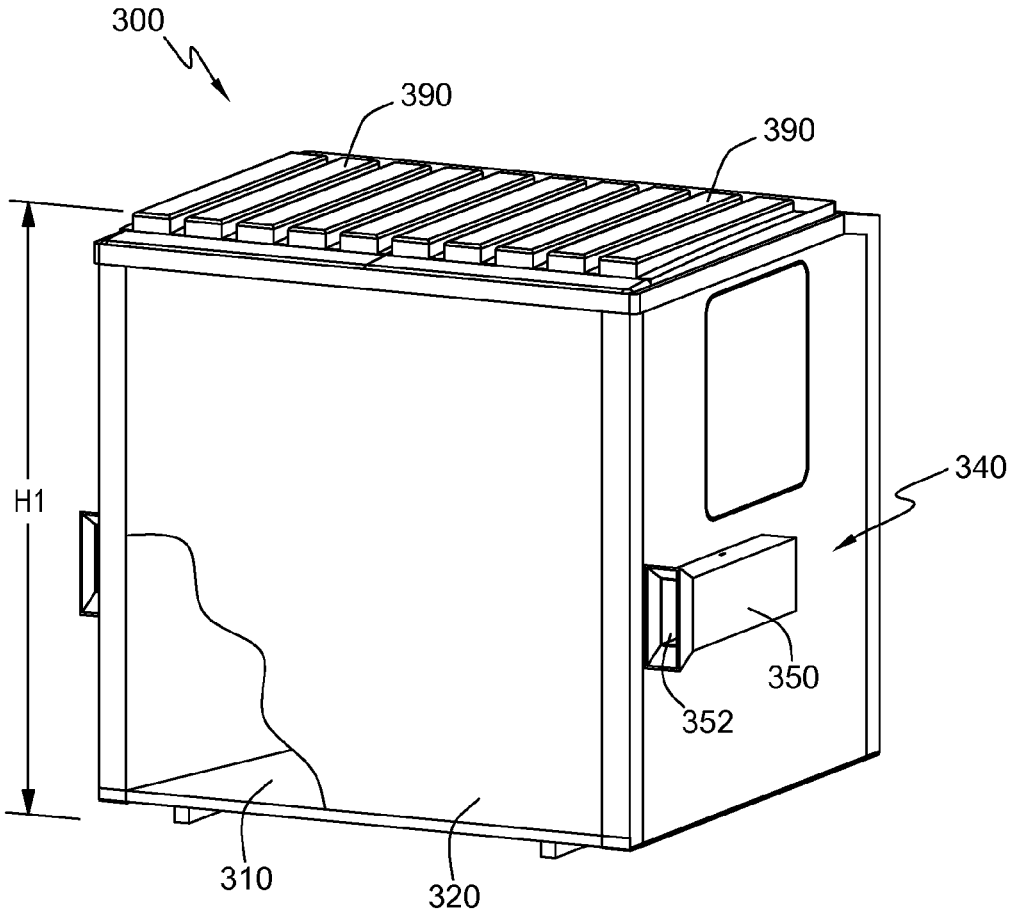
FIG. 4 is a front and a left side perspective view, partially cutaway, of the container of the unitary ornamental front load container of FIG. 1.
Figure 5:
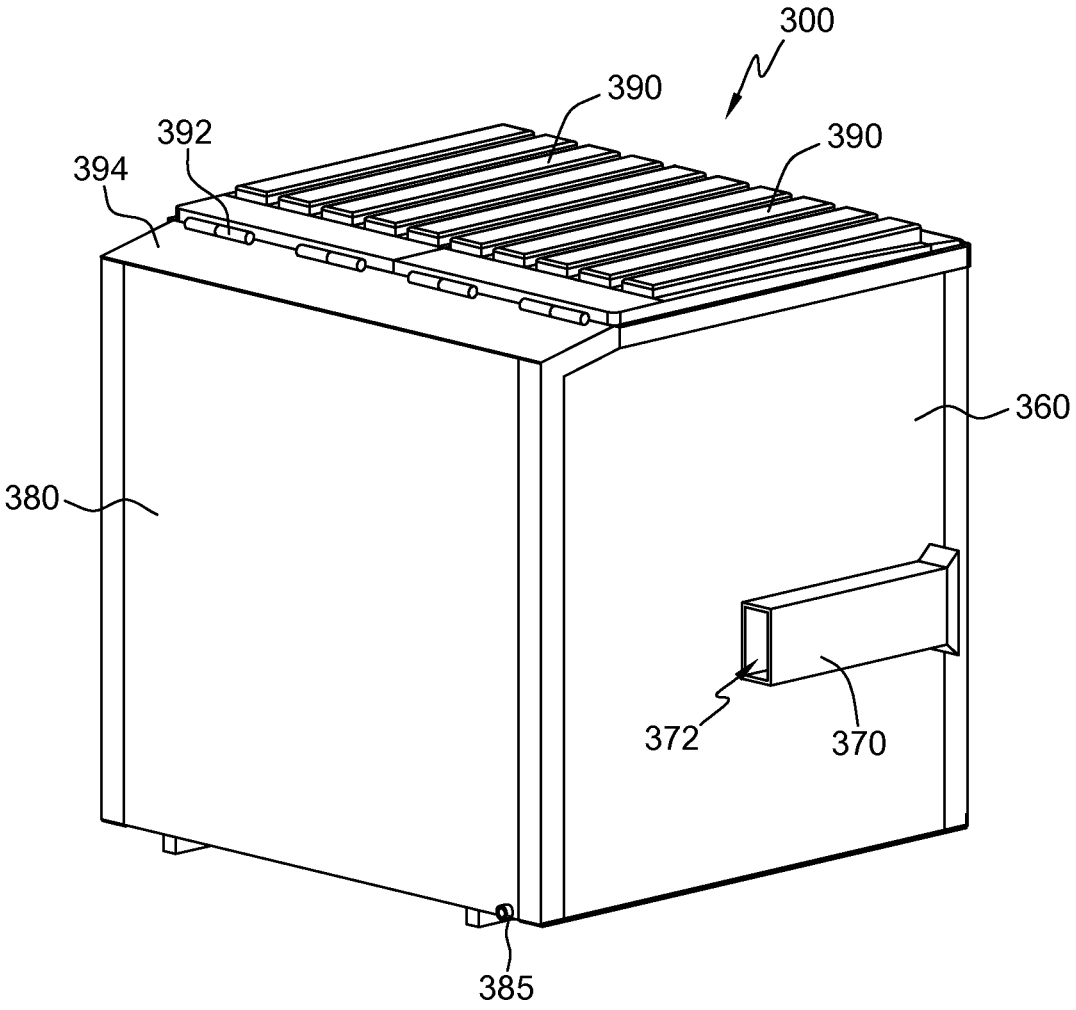
FIG. 5 is a rear and a right side perspective view of the container of the unitary ornamental front load container of FIG. 1.

As best shown in FIGS. 4 and 5, container 300 may include a bottom 310 (FIG. 4), a front sidewall 320 (FIG. 4), a left sidewall 340 (FIG. 4) having a left outwardly-extending fork pocket 350 (FIG. 4) having a left front pocket opening 352 (FIG. 4), a right sidewall 360 (FIG. 5) having a right outwardly-extending fork pocket 370 (FIG. 5) having a right front pocket opening 372 (FIG. 5), a rear sidewall 380 (FIG. 5), and at least one hinged top 390. Outwardly-extending fork pocket 350 may flare upwardly and downwardly, but not outwardly to the side (e.g., flush or flat along the outside) to form the pocket opening 372.

With reference again to FIGS. 2-5, ornamental surround 100 includes facade panel 120 disposed across front sidewall 320 (FIG. 4) of container 300 (FIG. 4), left side panel 140 (FIG. 2) disposed across left sidewall 340 (FIG. 4) and left outwardly-extending fork pocket 350 (FIG. 4) of container 300 (FIG. 4), right side panel 160 (FIG. 3) disposed across right sidewall 360 (FIG. 5) and right outwardly-extending fork pocket 370 (FIG. 5) of container 300 (FIG. 5), and rear side panel 180 (FIG. 3) disposed across rear sidewall 380 (FIG. 5) of container 300 (FIG. 5). Left and right outwardly-extending pockets may be generally horizontally disposed along the outer surface of the left and right sidewalls, respectively. Ornamental surround 100 obscures from view front sidewall 320 (FIG. 4), left sidewall 340 (FIG. 4) having the left outwardly-extending right fork pocket 350 (FIG. 4), right sidewall 360 (FIG. 5) having right outwardly-extending right fork pocket 370 (FIG. 5), rear sidewall 380 (FIG. 5), and at least one hinged top 390 (FIGS. 4 and 5) of the container by an observer standing on the ground.

Figure 6:
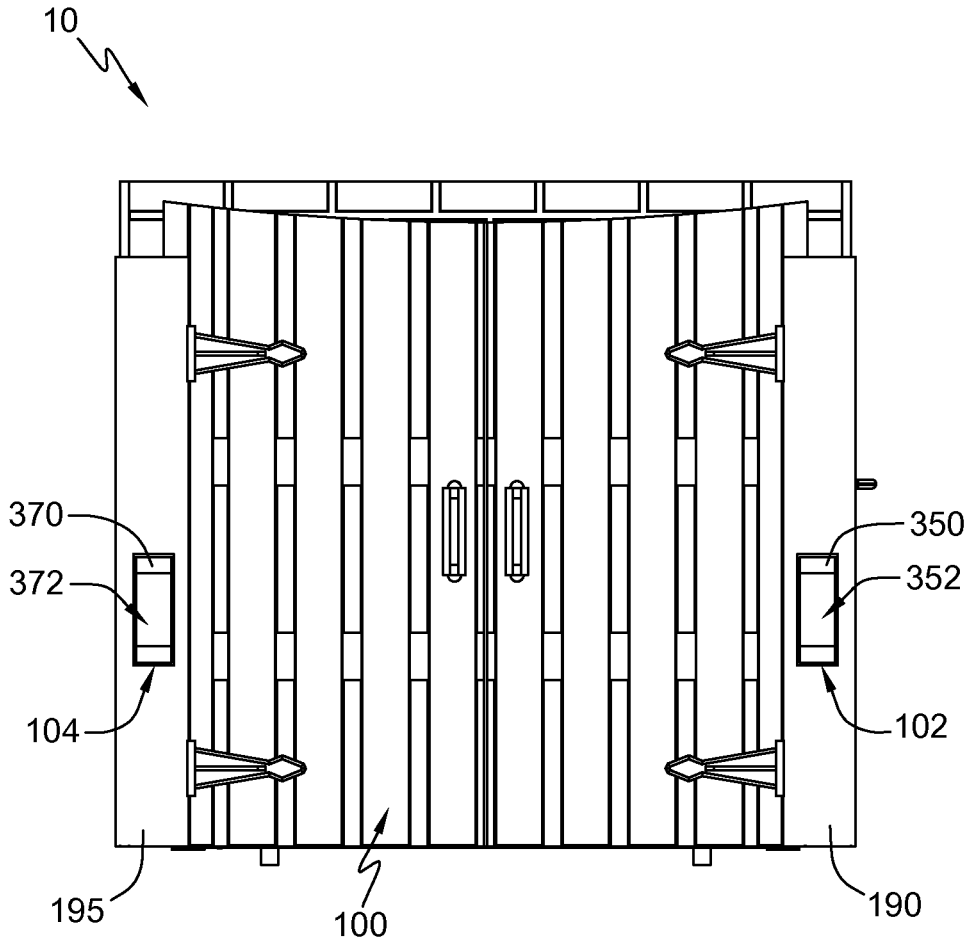
FIG. 6 is a front elevational view of the unitary ornamental front load container of FIG. 1 illustrating the folk openings.

As shown in FIG. 6, unitary ornamental front load container 10 includes ornamental surround 100 which defines left front opening 102 aligned with left front pocket opening 352 of left outwardly-extending fork pocket 350 of the container, and defines right front opening 104 aligned with right front pocket opening 372 of right outwardly-extending fork pocket 370 of the container. For example, elongated rounded members 190 and 195 may define left front opening 102 and right front opening 104, respectively. In other embodiments, the elongated rounded members or bumpers need not be provided, and the left and right vertical sides of the facade panel may extend outward over the front vertical edges of the left and right side panels and be provided with openings aligned with the pocket openings in the fork pockets of the container.

Figure 7:
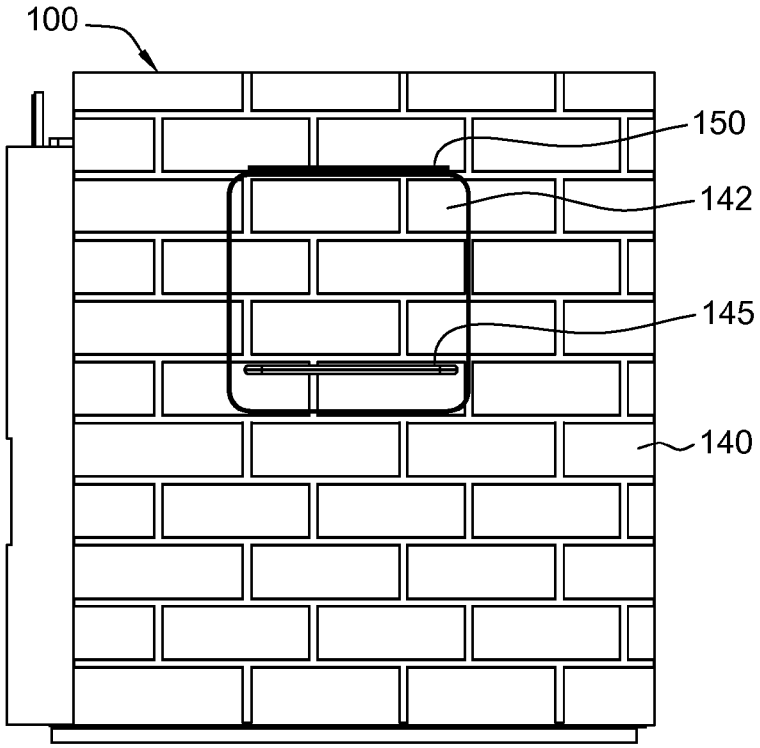
FIG. 7 is a left side elevational view of the unitary ornamental front load container of FIG. 1 illustrating the left side opening panel.
Figure 8:
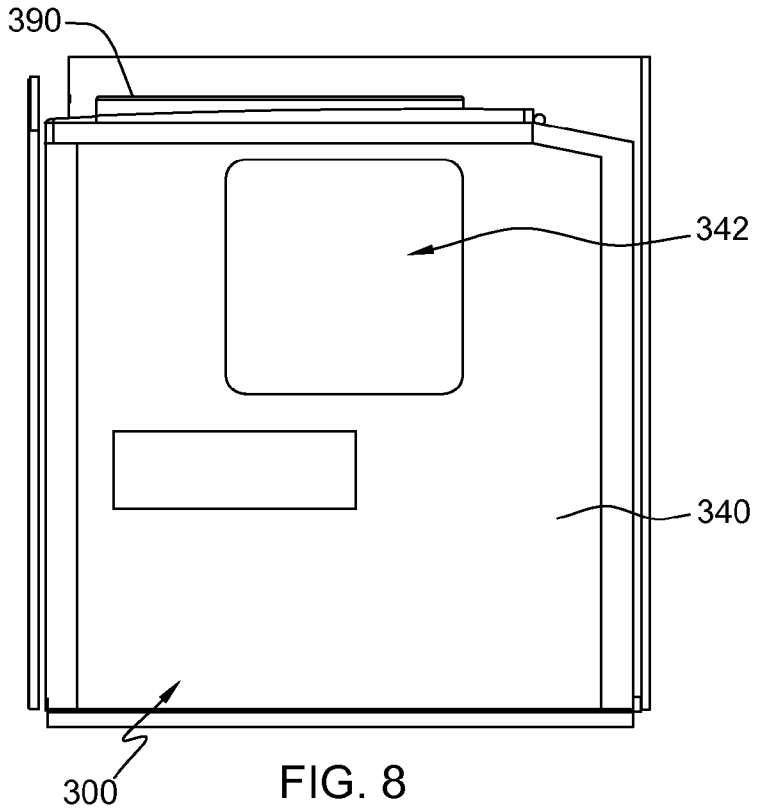
FIG. 8 is a left side elevational view of the unitary ornamental front load container of FIG. 1, with the left side panel removed, illustrating the aligned left sidewall opening of the container.

FIG. 7 illustrates left side panel 140 of ornamental surround 100 which may include a left side opening panel 142. Left side opening panel 142 may be aligned, as shown in FIG. 8, with a left sidewall opening 342 in left sidewall 340 of container 300. As shown in FIGS. 7 and 8, left side opening panel 142 (FIG. 7) and left sidewall opening 342 (FIG. 8) may be aligned and allow for relatively easily disposal of trash and/or recyclables by a user compared to disposal by lifting top 390 (FIG. 8). With reference again to FIG. 7, left side opening panel 142 may be hingedly attached to left side panel 140. For example, a hinge 150 may be operably attached to the upper edge of left side opening panel 142, and to left side panel 140. A handle 145 may be attached to left side opening panel 142 for pivotally opening left side opening panel 142. The container may include a sliding door (not shown) slidable across the left sidewall opening in the container. The left side panel and the left side opening panel may include a unitary design, as shown in FIG. 7. In other embodiments, a right side panel of the ornamental surround may include a right sidewall opening panel aligned with a right sidewall opening in the right sidewall of the container. In further embodiments, both the left side panels and the left sidewall, and the right side panels and right sidewall may be provided with aligned openings.

Figure 9:
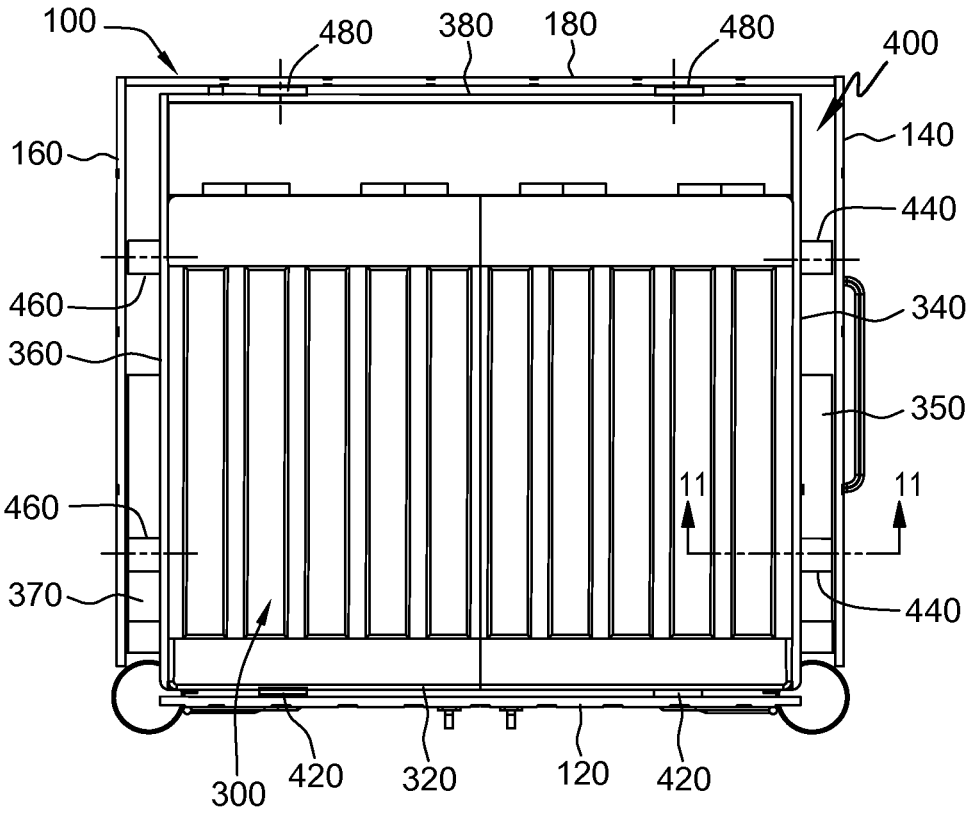
FIG. 9 is a top view of the unitary ornamental front load container of FIG. 1 illustrating a connector for attaching the ornamental surround to the containers.
Figure 10:
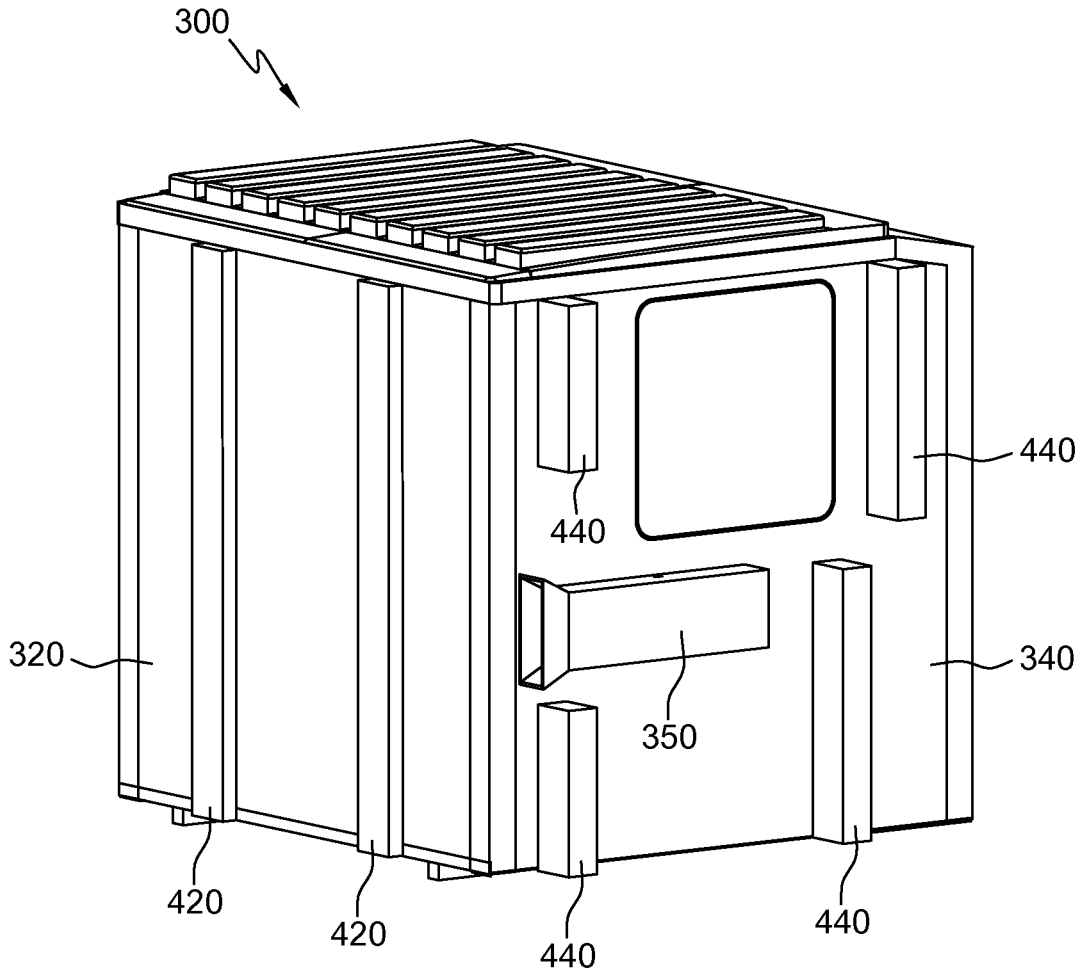
FIG. 10 is a front and a left side perspective view of the container of FIG. 1 illustrating a portion of the connector.
Figure 11:
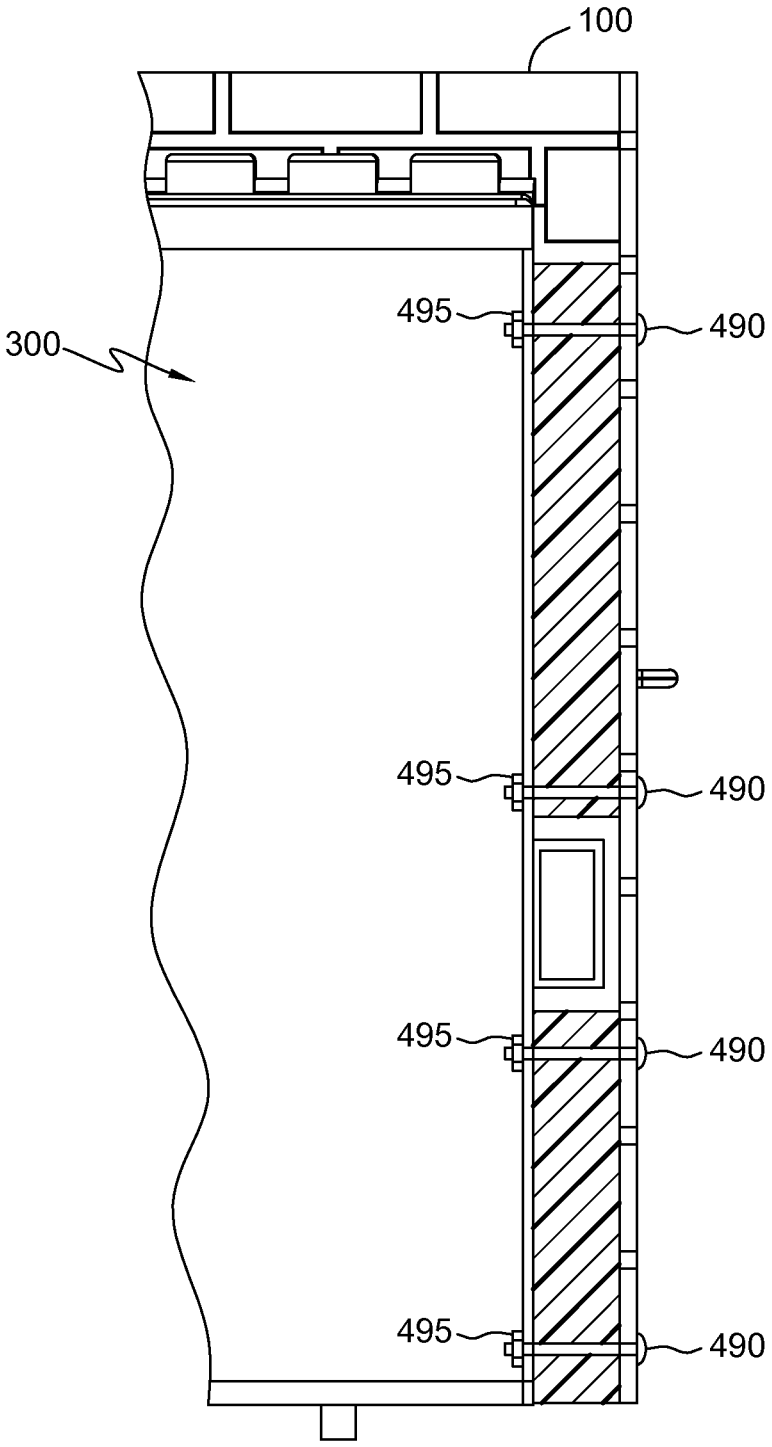
FIG. 11 is an enlarged cross-sectional view taken along lines 11-11 in FIG. 9, illustrating a portion of the connector for attaching the ornamental surround to the container.

FIGS. 9 and 10 illustrate one embodiment of a connector 400 (FIG. 9) for fixedly attaching the ornamental surround 100 (FIG. 9) to container 300 which may include a plurality of spacers or supports. For example, a plurality of spacers or supports 420 may be employed for supporting and attaching facade panel 120 (FIG. 9) to front sidewall 320 of container 300. A plurality of spacers or supports 440 may be employed for supporting and attaching left side panel 140 (FIG. 9) to left sidewall 340 of container 300. Supports 440 allow generally supporting left side panel 140 (FIG. 9) spaced apart and outwardly from left sidewall 340 and left side pocket 350. A plurality of spacers or supports 460 (FIG. 9) may be employed for supporting and attaching right side panel 160 (FIG. 9) to right sidewall 360 (FIG. 9) of container 300. Supports 460 (FIG. 9) allow left side panel 160 (FIG. 9) to be spaced apart and outwardly from right sidewall 360 (FIG. 9) and right side pocket 370 (FIG. 9). A plurality of spacers or supports 480 (FIG. 9) may be employed for supporting and attaching rear panel 180 (FIG. 9) to rear sidewall 380 (FIG. 9) of container 300. As shown in FIG. 11, the connector for fixedly attaching the ornamental surround 100 to container 300 may include a plurality of bolts 490 that extend through the ornamental surround, the plurality of supports, and the container, and which are secured with nuts 495. Aligned holes may be provided in the container, ornamental surround, and supports for receiving the bolts. The supports may be solid or may be hollow. It will be appreciated that in some embodiments, spacers may not be needed for attaching and supporting the facade panel to the front sidewall, or for attaching and supporting the rear panel to the rear sidewall.

Figure 12:
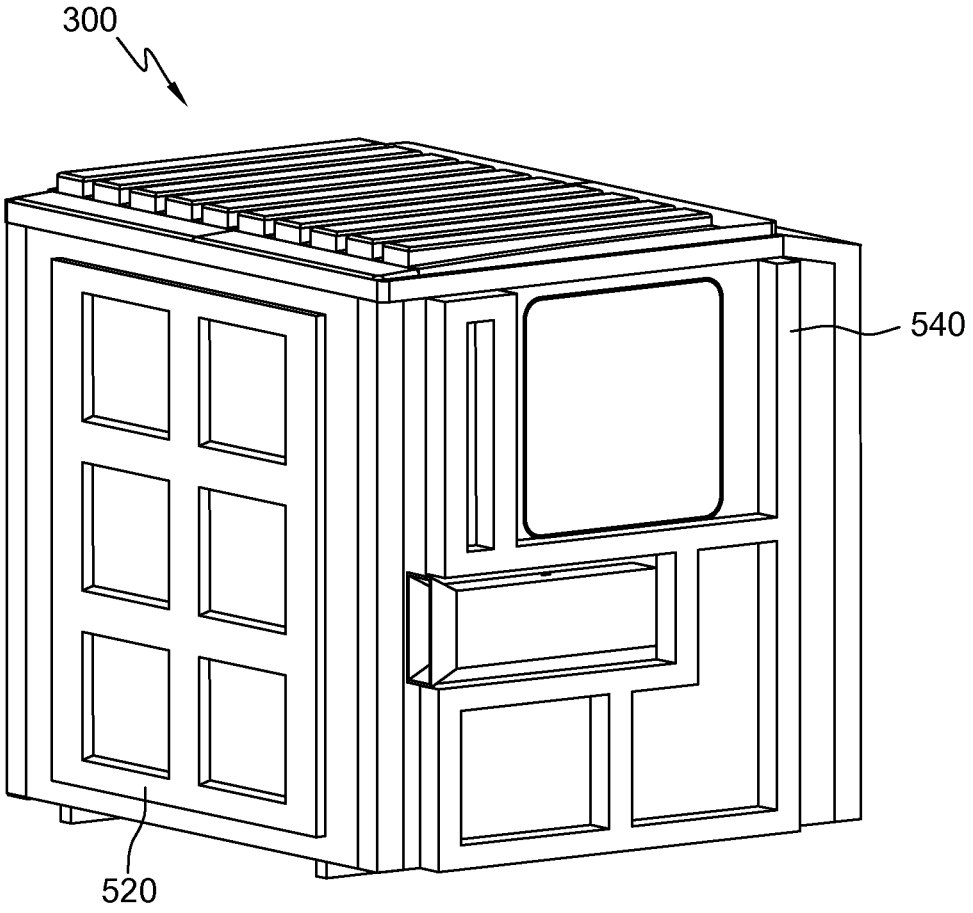
FIG. 12 is a front and a left side perspective view of the container of FIG. 1 and another embodiment of a portion of a connector in accordance with aspects of the present disclosure for use in attaching the ornamental surround to the container.

FIG. 12 illustrates another embodiment a left side support 540 in accordance with aspects of the present disclosure for attaching left side panel 140 (FIG. 9) of ornamental surround 100 (FIG. 9) to container 300, and a facade support 520 in accordance with aspects of the present disclosure for attaching facade panel 120 (FIG. 9) of ornamental surround 100 (FIG. 9) to container 300. In this illustrated embodiment, support 540 and support 520 may be configured in the shape of a grid-like pattern. A right side support may be the reverse of the left side support. A rear side support may be similar to the facade support.

Figure 13:
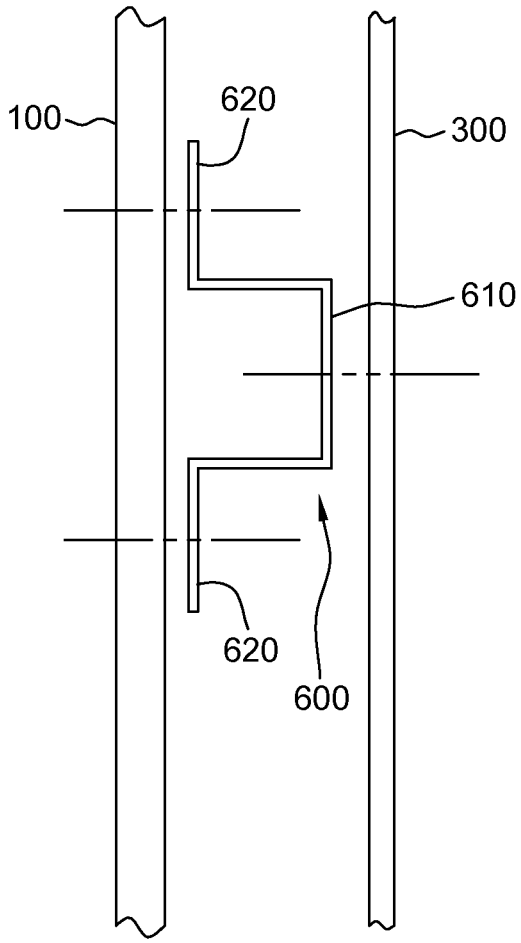
FIG. 13 is an exploded side elevational view of a portion of the surround and a portion of the container of FIG. 1, and another embodiment of a portion of a connector in accordance with aspects of the present disclosure for use in attaching the ornamental surround to the container.

FIG. 13 illustrates another embodiment a support 600 in accordance with aspects of the present disclosure for use in attaching ornamental surround 100 to container 300. Support 600 may be in the shape of an elongated furring channel or hat channel. A plurality of supports 600 may be used to attach the ornamental surround to the containers. For example, a middle portion 610 may be operably attached with bolts to container 300, and ends or legs 620 may be operably attached with bolts to surround 100. The bolts may have a rounded head that is placed along the inside of the container and/or along the outside of the ornamental surround. It will be appreciated that the orientation of support 600 may be flipped so that the middle portion abuts the ornamental surround and the legs abut the container. Supports 600 may extend horizontally, vertically or on an angle relative to the ground. Support 600 may be formed from steel, a polymeric material, or other suitable materials. In still other embodiments, the support may be molded into the ornamental surround, or welded to the container.

It will be appreciated that other operable connectors may be employed for attaching the ornamental surround to the container. For example, operable connector may include bolts and sleeves, hooks (one end of which secured to the container and the other end engaging the ornamental surround), or other suitable connector members or means. In other embodiments, the ornamental surround may be operably configured to incorporate the connectors, e.g., snap fit onto the container.

Figure 14:
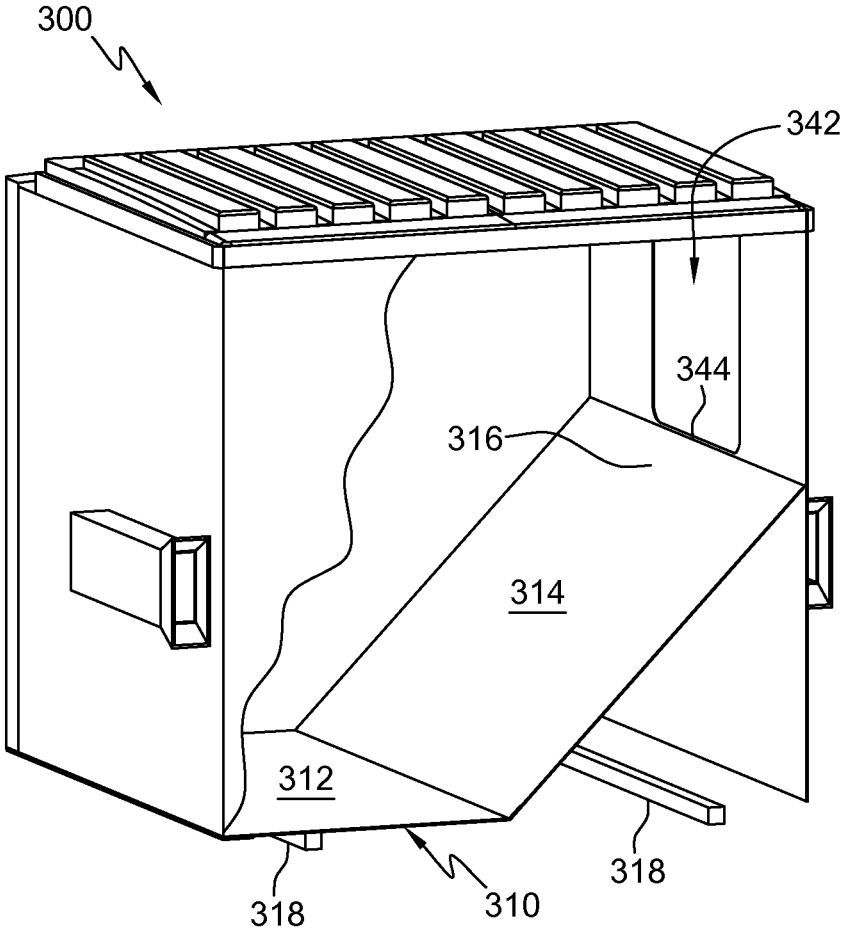
FIG. 14 is a front and a right side perspective view of the container of the unitary ornamental front load container of FIG. 1, partially cut away, illustrating the bottom having an angled bottom portion.

With reference to FIG. 14, bottom 310 of container 300 may include a lower horizontal portion 312, and an angled bottom portion 314. An upper portion 316 of angled bottom portion 314 may be disposed adjacent to a bottom edge 344 of left sidewall opening 342 and angled downwardly and away from the left sidewall opening of container 300. In other embodiments, for example, where a right sidewall opening in the right sidewall of the container is provided, the bottom may include an angled bottom portion that is disposed adjacent to a bottom edge of the right sidewall opening and angled downwardly and away from the right sidewall opening of the container. The angled bottom may be disposed on an angle of about 30 degrees to about 45 degrees, or about 37 degrees from the horizontal. The angled bottom may extend over 30 percent, 40 percent, 50 percent, 60 percent, or other percentage of the bottom. In other embodiments, the bottom may be an entirely horizontal bottom. With reference again to FIG. 5, container 300 may include a drain 385 disposed in rear sidewall 380 and disposed generally adjacent to horizontal bottom portion 312 (FIG. 14) of the bottom. A plurality of spaced-apart supports or stringers 318 may extend along the bottom of container 300 for raising the container off the surface of the ground.

With reference still to FIG. 5, container 300 may include a hinge 392 disposed forward and away from rear sidewall 380 of container 300 for pivotally connecting hinged top 390 to container 300. For example, container 300 may include a fixed angled rectangular planar portion 394 that is attached on three edges to rear sidewall 380, left sidewall 340 (FIG. 4), and right sidewall 360. A fourth edge may be attached to hinge 392. Angled rectangular planar portion 394 slopes downwardly to rear sidewall 380 and allows water to run off the top surface of angled rectangular planar portion 394 toward the back. Top 390 may also have a top surface that angles toward the front to allow water to run off toward the front. With reference again to FIG. 2, it will be appreciated that the top surface of top 390 will remain clear from hitting an upper edge 185 of rear side panel 180 of ornamental surround 100 when unitary ornamental front load container 100 is lifted, tipped, and emptied by a front loading garbage truck.

With reference again to FIGS. 2-5, unitary ornamental front load container 100 may include hinged top 390 of container 300 having a top surface disposed at a first vertical height H1 (FIG. 4) above the ground, and facade panel 120 (FIG. 2) may include an upper edge having a second vertical height H2 (FIG. 2) disposed above the ground. Second vertical height H2 may be greater than first vertical height H1. As shown in FIG. 2, left side panel 140, right side panel 160, and rear side panel 180 of ornamental surround 100 may include upper edges disposed at a third vertical height H3 above the ground. Third vertical height H3 may be greater than first vertical height H1 (FIG. 4). The third vertical height H3 may also be greater than second vertical height H2. For example, the vertical height of the ornamental surround may be about 5 feet to about 7 feet high, or about 6 feet high, or other suitable heights. The upper edges of the ornamental surround 100 may be disposed a distance of about 2 inches to about 7 inches, about 3 inches to about 6 inches, about 2 inches, about 3 inches, about 4 inches, about 5 inches, or a suitable distance above the upper surface of the hinged top of the container. The facade may have an upper scalloped edge, e.g., being lower in the middle compared to the sides.

Figure 15:
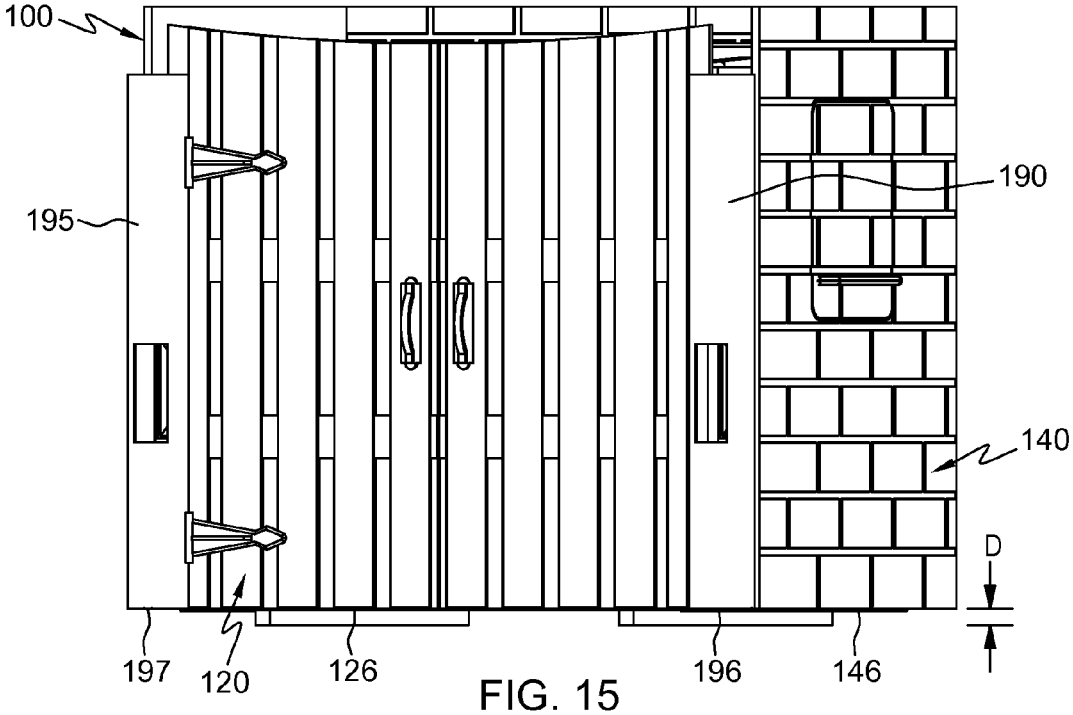
FIG. 15 is a front and a left side perspective view of the unitary ornamental front load container of FIG. 1 illustrating the ornamental surround being spaced above the ground.
Figure 16:
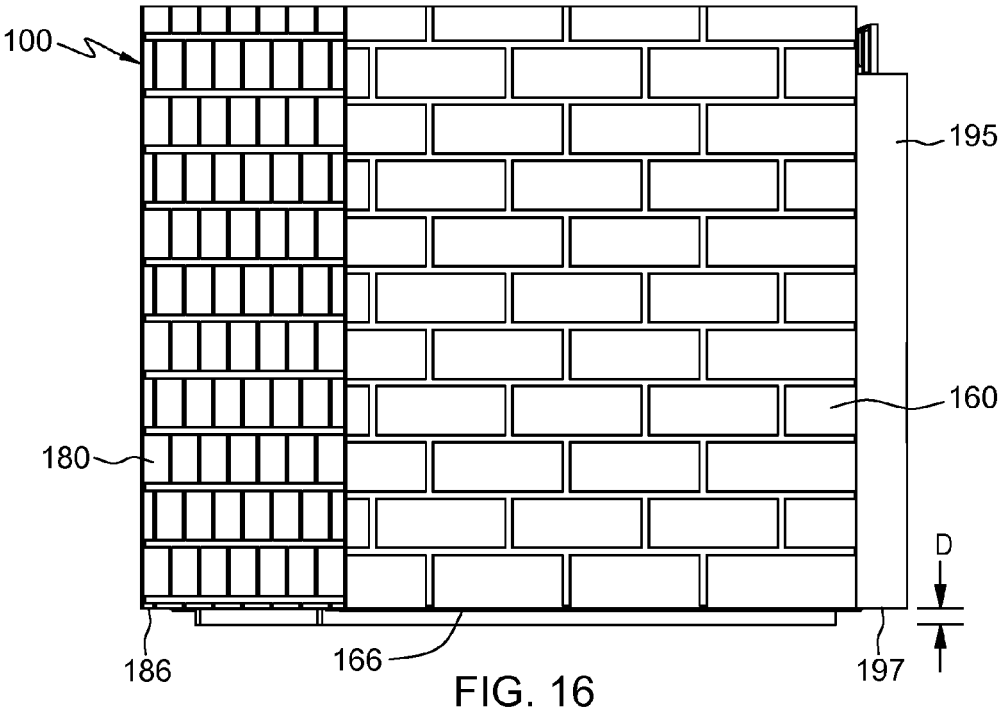
FIG. 16 is a rear and a right side perspective view of the unitary ornamental front load container of FIG. 1 illustrating the ornamental surround being spaced above the ground.

As shown in FIGS. 15 and 16, a bottom edge 126 of facade panel 120, a bottom edge 146 of left side panel 140, a bottom edge 166 of right side panel 160, a bottom edge 186 of rear side panel 180, and bottom edges 196 and 197 of elongated rounded members 190 and 195 respectively, may be vertically spaced above the ground. For example, the bottom edges of the ornamental surround 100 may be disposed a distance D of about 1 inch to about 5 inches, about 2 inches to about 3 inches, or a suitable distance off the ground. In other embodiment, the ornamental surround may have lower edges that are disposed or closely spaced adjacent to the ground.

Figure 17:
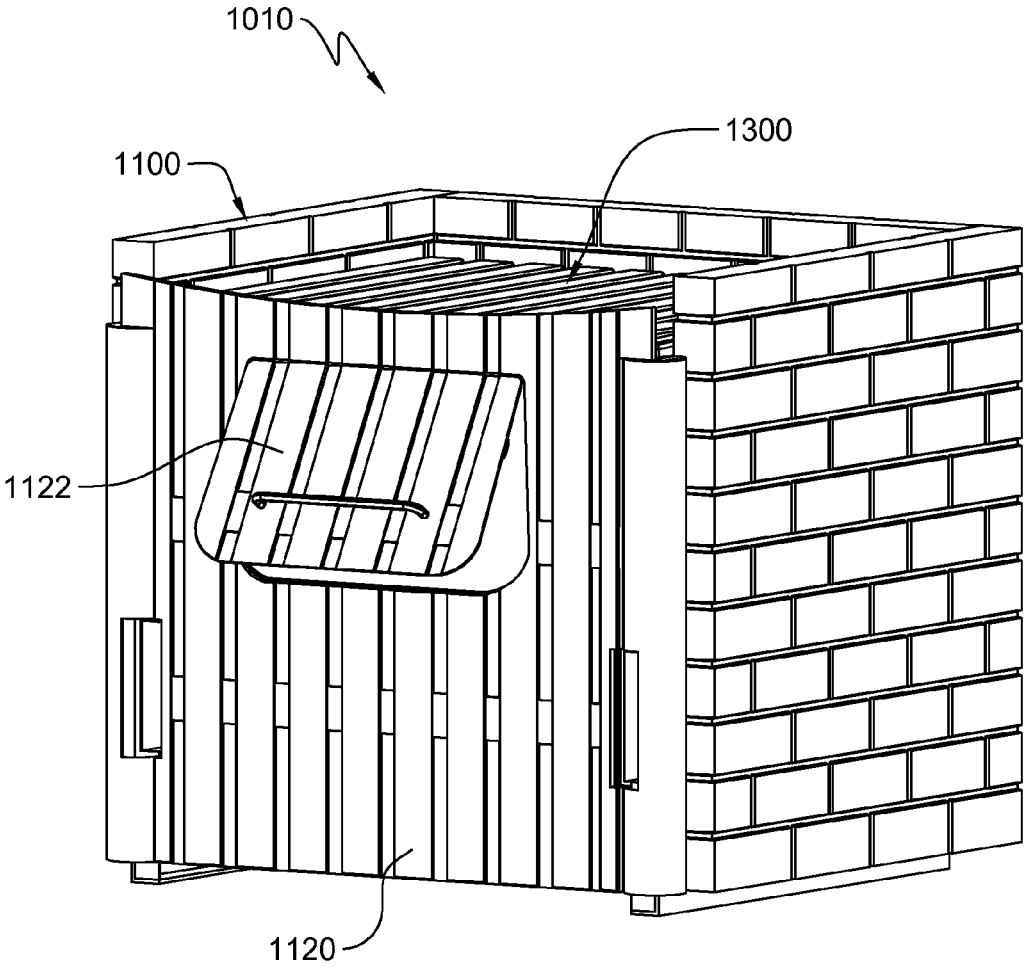
FIG. 17 is a perspective view of another embodiment of a unitary ornamental front load container in accordance with aspects of the present disclosure having a facade opening.
Figure 18:
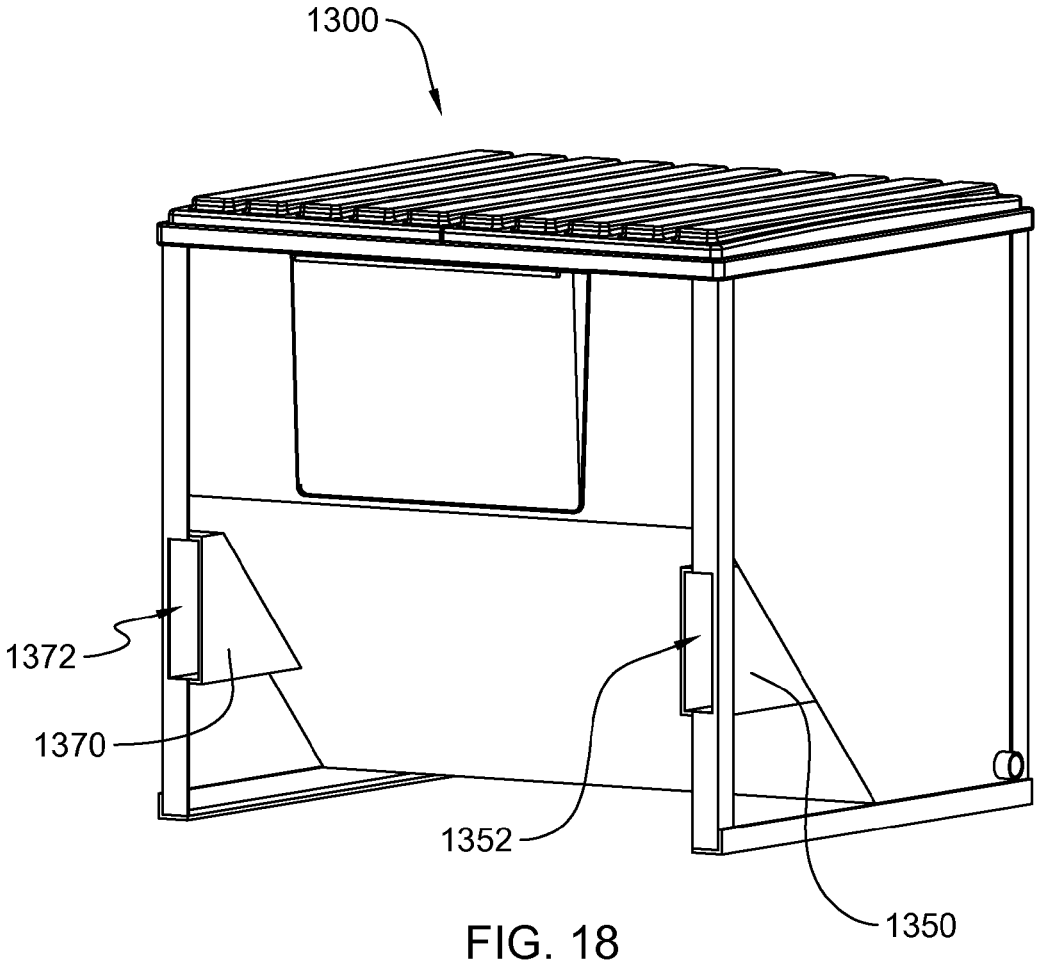
FIG. 18 is a perspective view of the container of the unitary ornamental front load container of FIG. 17 illustrating fork pockets that are disposed inwardly from the right and left sidewalls of the container.

FIG. 17 illustrates another embodiment of a unitary ornamental front load container 1010 having an ornamental surround 1100 and a container 1300 in accordance with aspects of the present disclosure for containing trash and/or recyclables. Unitary ornamental front load container 1010 is similar to unitary ornamental front load container 10 described above with the exception of a facade panel 1120 having a facade opening panel 1122, and as shown in FIG. 18, container 1300 having a left inwardly-extending fork pocket 1350 having a left front facing opening 1352, and a right inwardly-extending fork pocket 1370 having a right front facing opening 1372.

As will be appreciated from the present description, the unitary ornamental front load containers provide an attached ornamental surround that substantially obscures from view a container disposed therein by an observer standing on the ground. The attached ornamental surround is liftable along with the container as a unit, by forks of a front loading garbage truck, passing through opening in the ornamental surround, to empty trash and/or recyclable materials from the unitary ornamental front load containers into the garbage truck.

In the various embodiments, the unitary ornamental front load containers may include facade panels, right side panels, left side panels, and rear side panels which may be generally constant thickness planar panels that are generally vertically disposed. In the illustrated embodiments, the left side panel, the right side panel, and the rear side panel may have the appearance of being formed from a plurality of bricks or blocks. The front side panel may have the appearance of a plurality of slats. It will be appreciated that the ornamental surround may have any suitable aesthetically appealing appearance, for example, that obscures the look and function of the container disposed therein. Each of the panels may be one-piece construction or may be formed from a plurality of pieces.

The container may be formed from steel, aluminum, recycled tires, or other suitable materials or combination of materials. For example, the container may be formed from steel having a thickness of about 0.1 inch. The corners of the container may be reinforced with ¼ inch by 3 inch by 3 inch steel angles. The stringers 108 and 109 (FIG. 1) extending along the bottom may be formed from ⅛ inch by 3 inch by 2 inch steel tubes. The ornamental surround and the supports may be hollow or solid and formed from, for example, a polymeric material such as a generally hard or high density polyethylene polymer material, an open or closed cell foam material, or a laminate of two or more materials. The panels of the ornamental surround may have a thickness generally of about ¼ inch, about ½ inch, about ¾ inch, about 1 inch, about 2 inch, about ¼ inch to about 1 inch, about 1 inch to about 2 inches or greater than about 2 inches, or other suitable thicknesses. In other embodiments, the panels may be hollow allowing a reduction in weight compared to solid panels. For example, the panels forming the ornamental surround may be formed by rotational molding, a manufacturing process operable to create a low stress, hollow part. Rotational molding may include a heated hollow mold which is filled with a charge or shot weight of material. The mold and material is then slowly rotated (usually around two perpendicular axes) causing the softened material to disperse and stick to the walls of the mold. Rotating the mold during the heating phase maintains an even thickness throughout the part and avoids sagging or deformation also during the cooling phase. It will be appreciated that other manufacturing processes may be employed for forming the panels. For example, rotocasting or rotacasting may be employed which uses self-curing resins in rotated unheated molds.

The unitary ornamental front load containers may include an 8 yard container (operable to hold eight cubic yards of material) having a width of about 72 inches, a depth of about 70 inches, and a height of about 70 inches. Other sizes may include the container sized for containing 2 yards (e.g., about 80 inch width, about 40 inch depth, and 36 inch high), containing 4 yards (e.g., about 80 inch width, about 54 inch depth, and 48 inch high), containing 6 yards (e.g., about 80 inch width, about 66 inch depth, and 60 inch high), or containing 8 yards (e.g., about 80 inch width, about 66 inch depth, and 80 inch high). It will be appreciated that the container may have other suitable sizes and configuration.

In other embodiments, the facade may be have the appearance of being formed with a plurality of slats, e.g., need not inched hinges or handles. In other embodiments, the surround may be disposed across the front, and left and right sidewalls of the containers, e.g., the ornamental surround need not extend along the rear sidewall of the container such as where observers would not be able to observe the rear surface of the unitary ornamental front load container. In still other embodiments, where a plurality of unitary ornamental front load containers will be disposed in side-by-side relation, the unitary ornamental front load containers need only include a facade, and the outermost or end unitary ornamental front load container may include a facade panel, and a right or a left side panel.

In still other embodiments, a unitary ornamental front load container may not include a side opening. The hinged top may be reachable by a user in lifting the top and depositing trash or recyclables in the container.

Benefits and advantages of the present disclosure may include a more aesthetically pleasing refuse container employing an eco-friendly/recyclable materials, and/or elimination of a separate surround, e.g., installed fence or brick walls attached to the ground. Where lighter materials are used for the container, the unitary ornamental front load container may weigh less and be lighter to lift than a typical steel front end loan container thereby reducing delivery costs and/or wear and tear on the garbage trucks.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A unitary ornamental front load container for containing trash and/or recyclable materials, said unitary ornamental front load container comprising:

a container for containing the trash and/or recyclable materials, said container comprising a bottom, a front sidewall, a left sidewall having a left fork pocket having a left front pocket opening, a right sidewall having a right fork pocket having a right front pocket opening, a rear sidewall, and at least one hinged top;

an ornamental surround attached around said container, said ornamental surround comprising a facade panel disposed across said front sidewall of said container, a left side panel disposed across said left sidewall and said left fork pocket of said container, a right side panel disposed across said right sidewall and said right fork pocket of said container, and a rear side panel disposed across said rear sidewall;

said attached ornamental surround defining a left front opening aligned with said left front pocket opening of said left fork pocket of said container, and said attached ornamental surround defining a right front opening aligned with said right front pocket opening of said right fork pocket of said container;

said attached ornamental surround obscuring from view the container by an observer standing on the ground; and wherein said container and said attached ornamental surround being liftable as a unit by forks of a front loading garbage truck to empty the trash and/or the recyclable materials from said unitary ornamental front load container.

2. The unitary ornamental front load container of claim 1 wherein said left side panel of said ornamental surround comprises a left side opening panel aligned with a left sidewall opening in said left sidewall of said container, and/or wherein said right side panel of said ornamental surround comprises a right side opening panel aligned with a right sidewall opening in said right sidewall of said container.

3. The unitary ornamental front load container of claim 2 wherein said left side panel and said left side opening panel comprises a unitary design, and/or said right side panel and said right side opening panel comprises a unitary design.

4. The unitary ornamental front load container of claim 2 wherein said bottom of said container comprises a bottom portion disposed adjacent to a bottom edge of said left sidewall opening and angled downwardly and away from said left sidewall opening of said container, and/or said bottom of said container comprises a bottom portion disposed adjacent to a bottom edge of said right sidewall opening and angled downwardly and away from said right sidewall opening of said container.

5. The unitary ornamental front load container of claim 4 wherein said container comprises a drain.

6. The unitary ornamental front load container of claim 1 further comprising a plurality of supports disposed between said ornamental surround and said front sidewall, said left sidewall, said right sidewall, and/or said rear sidewall of said container.

7. The unitary ornamental front load container of claim 6 wherein said plurality of supports comprise a plurality of elongated members, elongated furring channels, and/or hat channels.

8. The unitary ornamental front load container of claim 6 further comprising a plurality of bolts extendable through said ornamental surround, said plurality of supports, and said container.

9. The unitary ornamental front load container of claim 1 wherein said left fork pocket comprises a left fork pocket outwardly-extending from said left sidewall, and said right fork pocket comprises a right fork pocket outwardly-extending from said right sidewall.

10. The unitary ornamental front load container of claim 9 further comprising:

a left support operable for supporting said left side panel spaced apart and outwardly from said left sidewall and said left outwardly-extending fork pocket; and a right support operable for supporting said right side panel spaced apart and outwardly from said right sidewall and said right outwardly-extending fork pocket.

11. The unitary ornamental front load container of claim 1 wherein said container comprises a hinge disposed forward and away from said rear sidewall of said container for pivotally connecting said at least one hinged top to said container, and wherein said top surface of said top remains clear from hitting an upper edge of said rear side panel of said ornamental surround when said unitary ornamental front load container is emptied by the front loading garbage truck.

12. The unitary ornamental front load container of claim 1 wherein said at least one hinged top of said container comprises a top surface disposed at a first vertical height above the ground, said facade panel comprising an upper edge having a second vertical height above the ground, and wherein said second vertical height is greater than said first vertical height.

13. The unitary ornamental front load container of claim 12 wherein said left side panel, said right side panel, and said rear side panel of said ornamental surround comprise upper edges disposed at a third vertical height above the ground, and wherein said third vertical height is greater than said first vertical height.

14. The unitary ornamental front load container of claim 13 wherein said third vertical height is greater than said second vertical height.

15. The unitary ornamental front load container of claim 1 wherein bottom edges of said facade panel, said left side panel, said right side panel, and said rear side panel are vertically spaced above the ground.

16. The unitary ornamental front load container of claim 1 wherein said facade panel, said right side panel, said left side panel, and said rear side panel comprise generally outer planar surfaces.

17. The unitary ornamental front load container of claim 1 wherein the ornamental surround further comprises a left rounded elongated vertically-extending member disposed between said facade and said left side panel, and a right rounded elongated vertically-extending member disposed between said facade and said right side panel.

18. The unitary ornamental front load container of claim 1 wherein said left side panel, said right side panel, and said rear side panel comprise the appearance of a plurality of bricks or blocks, and wherein said front side panel comprises the appearance of a plurality of slats.

19. The unitary ornamental front load container of claim 1 further comprising a plurality of bolts extending through said ornamental surround and said container.

20. The unitary ornamental front load container of claim 1 further comprising a left support operable for supporting said left side panel spaced apart and outwardly from the left sidewall and the left outwardly-extending fork pocket, and a right support operable for supporting said right side panel spaced apart and outwardly from the right sidewall and the right outwardly-extending fork pocket.

21. The unitary ornamental front load container of claim 20 further comprising a plurality of bolts extendable through said ornamental surround, said supports, and said container.

22. An ornamental surround attachable to a front load container comprising a bottom, a front sidewall, a left sidewall, a right sidewall, and a rear sidewall, and at least one hinged top, the left sidewall having a left fork pocket having a left front pocket opening, and the right sidewall having a right fork pocket having a right front pocket opening, said ornamental surround comprising:

a facade panel disposable across the front sidewall of the front load container;

a left side panel disposable across the left sidewall and the left fork pocket of the front load container;

a right side panel disposable across the right sidewall and the right fork pocket of the front load container;

a rear side panel disposable across the rear sidewall of the front load container;

said attachable ornamental surround defining a left front opening alignable with the left front pocket opening of the left fork pocket of the front load container, and said attachable ornamental surround defining a right front opening alignable with the right front pocket opening of the right fork pocket of the front load container;

said attachable ornamental surround is operable for obscuring from view the container by an observer standing on the ground; and wherein the front load container and said attached ornamental surround being liftable as a unit by forks of a front loading garbage truck to empty the trash and/or the recyclable materials from the front load container.

23. The ornamental surround of claim 22 wherein said left side panel of said ornamental surround comprises a left side opening panel alignable with a left sidewall opening in the left sidewall of the front load container, and/or said right side panel of said ornamental surround comprises a right side opening panel alignable with a right sidewall opening in the right sidewall of the front load container.

24. The ornamental surround of claim 23 wherein said left side panel and said left side opening panel comprises a unitary design, and/or said right side panel and said right side opening panel comprises a unitary design.

25. The ornamental surround of claim 22 wherein said attachable ornamental surround being operable for obscuring from view the front sidewall, the left sidewall having a left outwardly-extending left fork pocket, the right sidewall having a right outwardly-extending right fork pocket, the rear sidewall, and the at least one hinged top of the front load container by the observer standing on the ground.

26. The ornamental surround of claim 22 further comprising a left support operable for supporting said left side panel spaced apart and outwardly from the left sidewall and the left outwardly-extending fork pocket, and a right support operable for supporting said right side panel spaced apart and outwardly from the right sidewall and the right outwardly-extending fork pocket.

27. The ornamental surround of claim 26 wherein said supports comprise a plurality of elongated members, elongated furring channels, and/or hat channels.

28. The ornamental surround of claim 22 wherein said ornamental surround is attachable to the front load container so that top edges of said facade panel, said left side panel, said right side panel, and said rear side panel are disposed above top edges of the front load container, and said ornamental surround is attachable to the front load container so that bottom edges of said facade panel, said left side panel, said right side panel, and said rear side panel are disposed above the ground.

29. The ornamental surround of claim 22 wherein said front side panel, said left side panel, said left side panel, and said rear side panel comprise generally outer planar surfaces.

30. The ornamental surround of claim 22 further comprising a left rounded elongated vertically-extending member disposed between said facade and said left side panel, and a right rounded elongated vertically-extending member disposed between said facade and said right side panel.

31. The ornamental surround of claim 22 wherein said left side panel, said right side panel, and said rear side panel comprise the appearance of a plurality of bricks or blocks, and wherein said front side panel comprises the appearance of a plurality of slats.

32. The ornamental surround of claim 22 wherein said ornamental surround comprises a polymeric material.

33. The ornamental surround of claim 22 wherein said ornamental surround comprises holes for receiving bolts extendable through said ornamental surround and the front load container.

34. The ornamental surround of claim 22 further comprising a plurality of bolts extendable through said ornamental surround and the front load container.

35. A method for forming an ornamental refuse container for containing trash and/or recyclable materials, the method comprising:

providing the ornamental surround of claim 22; and attaching the ornamental surround to a front load container.

* * * * *